US007702419B2

(12) United States Patent
Kinalski et al.

(10) Patent No.: US 7,702,419 B2
(45) Date of Patent: Apr. 20, 2010

(54) SYSTEM AND METHOD FOR FILLING A RESERVOIR

(75) Inventors: Michael Kinalski, Boise, ID (US); Markus Ditzel, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1757 days.

(21) Appl. No.: 10/198,545

(22) Filed: Jul. 16, 2002

(65) Prior Publication Data

US 2004/0012645 A1 Jan. 22, 2004

(51) Int. Cl.
*G07F 7/00* (2006.01)

(52) U.S. Cl. ..... 700/240; 399/24; 399/27; 347/7

(58) Field of Classification Search ..... 399/12, 399/24–25, 27; 347/7; 700/240
See application file for complete search history.

(56) References Cited

U.S. PATENT DOCUMENTS 4,929,818 A * 5/1990 Bradbury et al. ..... 235/381
5,283,613 A * 2/1994 Midgley, Sr. ..... 399/9
5,461,469 A * 10/1995 Farrell et al. ..... 399/407
5,629,981 A * 5/1997 Nerlikar ..... 713/168
5,995,774 A * 11/1999 Applegate et al. ..... 399/27
6,056,194 A * 5/2000 Kolls ..... 235/381
6,092,726 A * 7/2000 Toussant et al. ..... 235/383
6,181,885 B1 * 1/2001 Best et al. ..... 399/12
6,226,463 B1 * 5/2001 Phillips et al. ..... 399/24
6,233,410 B1 * 5/2001 Seber et al. ..... 399/24
6,263,170 B1 * 7/2001 Bortnem ..... 399/13
6,332,481 B1 * 12/2001 Shinada et al. ..... 141/18
6,351,618 B1 * 2/2002 Pollocks, Jr. ..... 399/12
6,467,888 B2 * 10/2002 Wheeler et al. ..... 347/85
6,536,484 B2 * 3/2003 Hewlitt et al. ..... 141/2

(Continued)

FOREIGN PATENT DOCUMENTS

JP 09269646 A * 10/1997

*Primary Examiner*—Jeffrey A Shapiro

(57) ABSTRACT

A system for automatically filling a reservoir. The system includes a first mechanism that automatically determines one or more parameters associated with the reservoir. A second mechanism fills the reservoir with an appropriate amount and type of filler based on the one or more parameters. In a specific embodiment, the one or more parameters include filler type and current filler level information. The parameters also include an identification number associated with a user of the reservoir. Upon filling of the reservoir, a billing system automatically bills or charges a user based on the identification number and filler level information obtained via the first mechanism. The billing system includes a database that maintains billing information associated with the identification number. The billing system further includes a network connection that facilitates communications with the database. A control panel and accompanying user-interface software enables a user to edit the identification number and/or to edit a charge number associated with the identification number. A reservoir sensor measures the current filler level in the reservoir and provides the filler level information in response thereto. A dispensing container accommodates the reservoir and transfers filler from the dispensing container to the reservoir in response to a signal from the first mechanism. A container level sensor senses current filler levels in the container and provides container filler level information to a remote monitoring system via a network in response thereto. In a more specific embodiment, the reservoir is a printer cartridge, and the filler is printing consumable, such as toner. The first mechanism includes an electronic storage device attached to the printer cartridge that communicates with the reservoir sensor and maintains the parameters describing the reservoir.

15 Claims, 3 Drawing Sheets

U.S. PATENT DOCUMENTS 6,571,071 B2 * 5/2003 Kanoshima et al. ..... 399/79
6,578,763 B1 * 6/2003 Brown ..... 235/435
6,585,009 B2 * 7/2003 Matthews et al. ..... 141/67
6,634,738 B1 * 10/2003 Shinada et al. ..... 347/86
6,644,771 B1 * 11/2003 Silverbrook ..... 347/19
6,653,946 B1 * 11/2003 Hassett ..... 340/928
6,738,903 B1 * 5/2004 Haines ..... 713/168
6,761,318 B2 * 7/2004 Dudek et al. ..... 235/487
6,772,944 B2 * 8/2004 Brown ..... 235/376

* cited by examiner

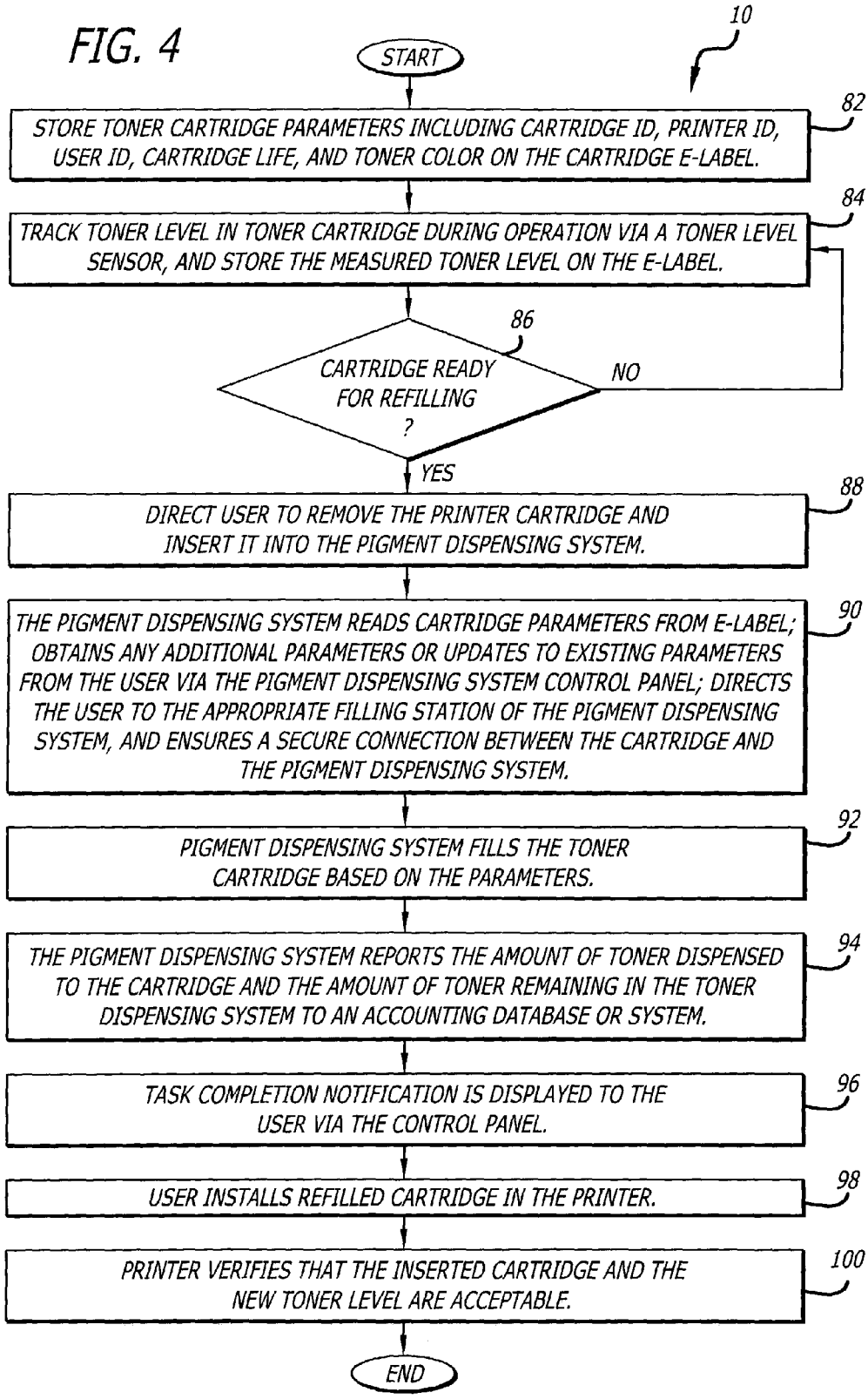
FIG. 4
10
START
82
STORE TONER CARTRIDGE PARAMETERS INCLUDING CARTRIDGE ID, PRINTER ID, USER ID, CARTRIDGE LIFE, AND TONER COLOR ON THE CARTRIDGE E-LABEL.
84
TRACK TONER LEVEL IN TONER CARTRIDGE DURING OPERATION VIA A TONER LEVEL SENSOR, AND STORE THE MEASURED TONER LEVEL ON THE E-LABEL.
86
CARTRIDGE READY FOR REFILLING ?
NO
YES
88
DIRECT USER TO REMOVE THE PRINTER CARTRIDGE AND INSERT IT INTO THE PIGMENT DISPENSING SYSTEM.
90
THE PIGMENT DISPENSING SYSTEM READS CARTRIDGE PARAMETERS FROM E-LABEL; OBTAINS ANY ADDITIONAL PARAMETERS OR UPDATES TO EXISTING PARAMETERS FROM THE USER VIA THE PIGMENT DISPENSING SYSTEM CONTROL PANEL; DIRECTS THE USER TO THE APPROPRIATE FILLING STATION OF THE PIGMENT DISPENSING SYSTEM, AND ENSURES A SECURE CONNECTION BETWEEN THE CARTRIDGE AND THE PIGMENT DISPENSING SYSTEM.
92
PIGMENT DISPENSING SYSTEM FILLS THE TONER CARTRIDGE BASED ON THE PARAMETERS.
94
THE PIGMENT DISPENSING SYSTEM REPORTS THE AMOUNT OF TONER DISPENSED TO THE CARTRIDGE AND THE AMOUNT OF TONER REMAINING IN THE TONER DISPENSING SYSTEM TO AN ACCOUNTING DATABASE OR SYSTEM.
96
TASK COMPLETION NOTIFICATION IS DISPLAYED TO THE USER VIA THE CONTROL PANEL.
98
USER INSTALLS REFILLED CARTRIDGE IN THE PRINTER.
100
PRINTER VERIFIES THAT THE INSERTED CARTRIDGE AND THE NEW TONER LEVEL ARE ACCEPTABLE.
END

SYSTEM AND METHOD FOR FILLING A RESERVOIR

BACKGROUND OF THE INVENTION

1. Field of Invention

This invention relates to reservoir filling systems. Specifically, the present invention relates to systems and methods for automatically refilling reservoirs, such as printing consumable or ink/toner reservoirs.

2. Description of the Related Art

Reservoir refilling systems are employed in various demanding applications including gas stations, automated candy manufacturing machines, water bottle filling stations, hazardous materials operations, and printing consumable or ink/toner reservoir replenishment systems. Such applications often demand efficient and cost-effective reservoir filling systems.

Efficient reservoir filling systems are particularly important in printing applications such as laser printers, inkjet printers, facsimile machines, photocopying machines, postage printing machines, and label printers. In these applications, systems for efficiently replacing printing consumable, such as ink or toner, may significantly reduce printer operating costs.

Conventionally, a consumable or ink/toner reservoir, such as printer toner cartridge, is replaced when the consumable or ink/toner is depleted. Unfortunately, manufacturing, distributing, and disposing replacement printer cartridges is undesirably inefficient, costly, and environmentally unfriendly.

To mitigate the environmental impact of printer cartridge disposal, printer cartridges are often recycled. However, recycling, re-distribution, and printer cartridge inventory management costs remain undesirably high.

Hence, a need exists in the art for an efficient and cost-effective system and method for replenishing a reservoir with an appropriate amount and type of filler. There exists a further need for a system that can automatically bill a user for the filler dispensed.

SUMMARY OF THE INVENTION

The need in the art is addressed by the system for replenishing a reservoir of the present invention. In the illustrative embodiment, the inventive system is adapted for use with printer cartridges. The system includes a first mechanism for automatically determining one or more parameters associated with the reservoir. A second mechanism fills the reservoir with a filler based on the one or more parameters.

In a more specific embodiment, the one or more parameters include filler type and filler level parameters that specify the type of filler required by the reservoir and the current level of filler in the reservoir, respectively. The parameters further include an identification number associated with a user of the reservoir. A billing mechanism charges or bills a user based on the identification number and filler level parameter obtained by the first mechanism after the second mechanism fills the reservoir. The billing mechanism includes a database for maintaining billing information associated with the identification number. The billing mechanism includes a network connection that facilitates communications with the database.

The system further includes a user-interface and accompanying software for enabling a user of the system to edit the identification number or to edit a charge number associated with the identification number. The identification number may be a credit card number or a debit card number.

The first mechanism includes a reservoir sensor that periodically measures the current reservoir filler level and updates the filler level parameter in response thereto. A dispensing container has a receptacle for accommodating the reservoir and for transferring filler from the dispensing container to the reservoir in response to a signal from the first mechanism. A container level sensor senses current filler levels in the dispensing container and forwards container filler level information to a remote monitoring system via a network.

In a more specific embodiment, the reservoir is a printer cartridge, and the filler is printing consumable, such as toner or ink. The first mechanism includes an electronic storage medium attached to the printer cartridge. The electronic storage medium stores parameters associated with the reservoir and communicates with the reservoir level sensor. In the specific embodiment, the reservoir sensor is positioned on or within the printer cartridge; measures the consumable or ink/toner level remaining in the cartridge; and stores the filler level information on the electronic storage medium.

The novel design of the present invention is facilitated by the use of an electronic label to store selectively updated descriptive parameters that enable automatic and accurate reservoir filling and associated billing operations. Advantages are particularly apparent in toner type printing applications and automotive refueling applications where user errors, such as spilling or over-filling, are undesirably costly and environmentally unfriendly.

In printing applications, printer cartridge information, such as color, current toner level, and charge information is prestored on the electronic storage medium, such as chip or microstrip fixed to the toner cartridge. Consequently, user errors, such as inputting erroneous charge information, selecting the wrong toner type or color, user spilling, and so on, are greatly reduced. Furthermore, the process of refilling the toner cartridge, billing the user, analyzing toner inventory and usage, and procuring additional toner are greatly expedited. In addition, economic and environmental costs associated with toner cartridge disposal are reduced or eliminated.

BRIEF DESCRIPTION OF THE DRAWINGS

FIG. 4 is a flow diagram of a method adapted for use with the filler dispensing system of FIG. 1.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
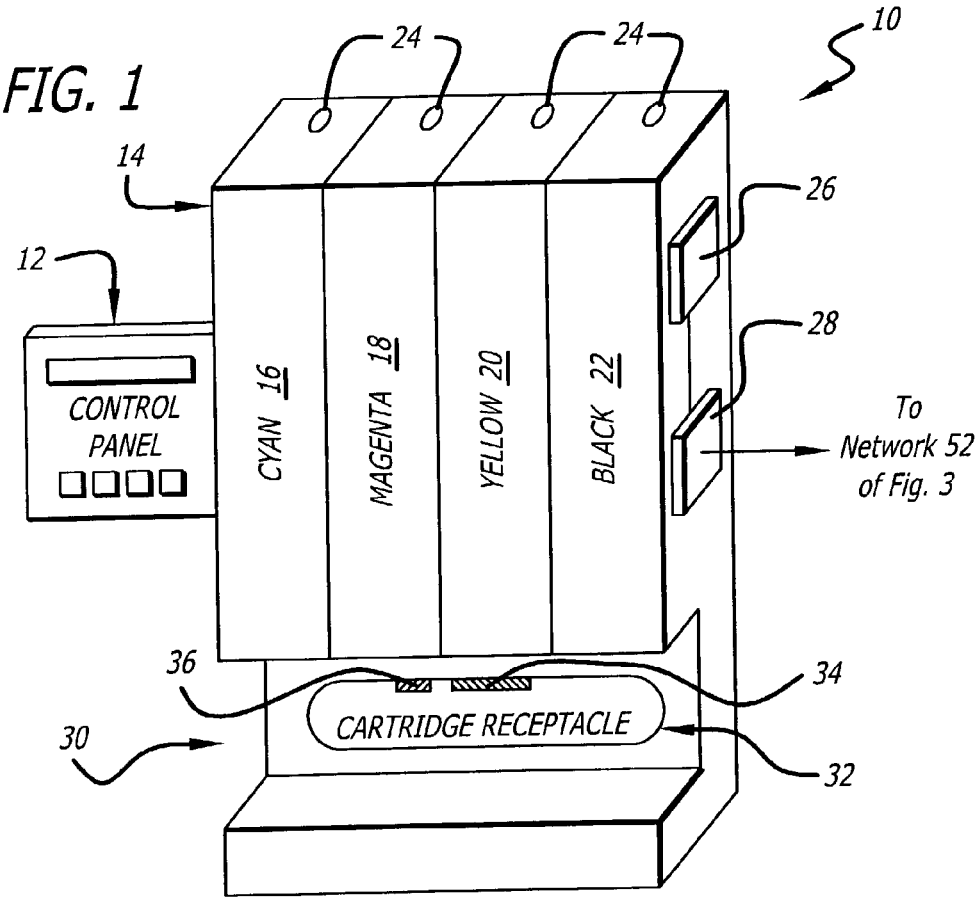
FIG. 1 is a perspective view of a filler dispensing system constructed in accordance with the teachings of the present invention.

FIG. 1 is a perspective view of a filler dispensing system 10 constructed in accordance with the teachings of the present invention. For clarity, various well-known components, such as power supplies, actuators, valves, and so on, have been omitted from the figures. However, those skilled in the art with access to the present teachings will know which components to implement and how to implement them to meet the needs of a given application.

The system 10 includes a control panel 12 mounted on a dispensing system housing 14. In the present specific embodiment, the housing 14 incorporates a cyan toner container 16, a magenta toner container 18, a yellow toner container 20, and a black toner container 22, each having an input aperture 24. An optional card reader 26 is mounted on the housing 14 and is connected to a network interface 28. The housing 14 includes a slot 30 that accommodates a cartridge-refilling receptacle 32. The receptacle 32 accommodates an electronic reader/writer 34 for reading parameters from electronic labels (e-labels) on printer cartridges as discussed more fully below. The cartridge receptacle 32 also accommodates a toner feed system 36 for selectively transferring cyan, magenta, yellow, or black toner from the containers 16-22 to printer cartridges inserted into the cartridge receptacle 32.

Figure 2:
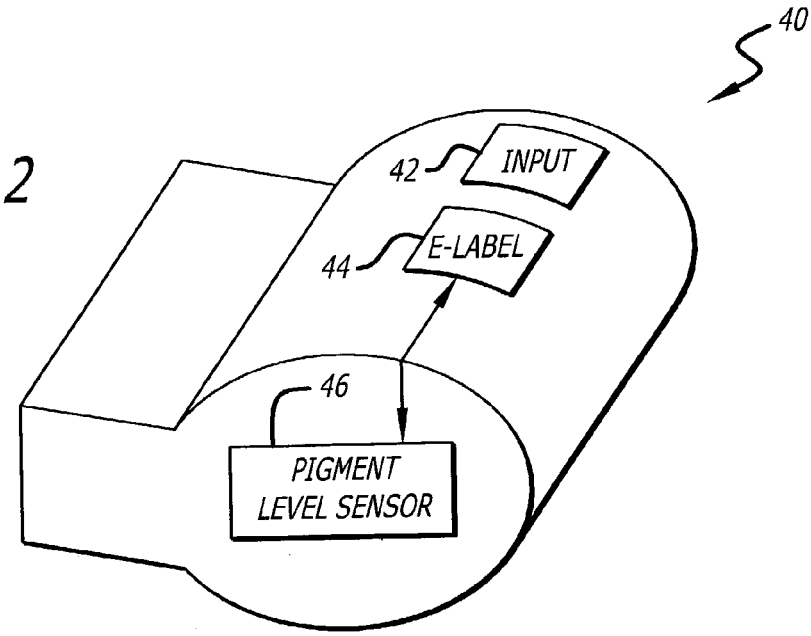
FIG. 2 is a diagram of a printer cartridge adapted for use with the filler dispensing system of FIG. 1.

FIG. 2 is a diagram of a printer cartridge 40 adapted for use with the filler dispensing system 10 of FIG. 1. The printer cartridge 40 is a removable cartridge designed to withstand multiple refills. The printer cartridge 40 includes a toner input 42 for receiving toner. Toner level sensors 46, which are connected to an e-label 44, periodically monitor toner levels in the cartridge 40 and forward toner level information to the e-label 44 in response thereto. The e-label 44 is mounted on the surface of the cartridge 40 and electronically stores cartridge parameters, including current toner (filler) level, toner type, toner color, cartridge capacity, user identification number (billing information), cartridge life, printer identification number (identifying the printer associated with the printer cartridge), and a printer cartridge identification number. The printer identification number or printer cartridge identification number may be omitted and looked-up in database instead. The user identification number acts as a billing identification number, which may be employed to reference charging information, such as credit card numbers, or may be a charge number or credit card number. Furthermore, additional parameters or fewer parameters may be employed without departing from the scope of the present invention.

In operation, with reference to FIGS. 1 and 2, a user determines that the toner cartridge 40 needs refilling and inserts the cartridge 40 into the cartridge receptacle 32 of the filler dispensing system 10 of FIG. 1. The control panel 12 guides the user though the insertion process to minimize human error. For example, the control panel 12 may display a user-friendly help menu that may be easily navigated by a user requiring assistance.

Parameters, including toner type, color, remaining cartridge capacity, are read by the e-label reader/writer 34 and forwarded to a controller internal to the dispensing system 10, as discussed more fully below. The controller then activates one of the nozzles of the toner feed system 36 that is connected to a corresponding toner container 16, 18, 20, or 22. For example, if the controller determines that the cartridge 40 accommodates black toner, an appropriate nozzle or conduit of the toner feed system 36 will direct black toner from the black toner container 22 to the toner cartridge input 42 via a conduit (not shown) from the black container 22 to the nozzle 36. The amount of black toner transferred to the cartridge 40 is based on the difference between the current toner level and the toner capacity parameters read from the e-label 44 by the e-label reader/writer 34. Alternatively, the remaining capacity of the toner cartridge 40 may be stored as a single parameter. The e-label reader/writer 34 may employ direct contact (electrical contact), conventional radio frequency, infrared, or other well-known reading/writing mechanisms to read and/or write to or from the e-label 44.

By default, the filler dispensing system 10 completely fills the toner cartridge 40. However, a user may override this default via the control panel 12. In this case, the user enters the desired amount of toner to be transferred to the toner cartridge 40, while the controller ensures that the toner transferred is not more than can be accommodated by the toner cartridge 40. The projected cost of the refill may be displayed via the control panel 12. The user may have the option to abort, continue, or adjust the refilling operation to dispense less toner or a different type of toner. Different applications may demand different levels of user control over the refilling operation.

The e-label 44 may be implemented as a memory chip, a micro controller with accompanying memory, a microstrip flex circuit, or other read/write electronic labeling technology. Those skilled in the art with access to the present teachings will know how to implement the e-label 44 to meet the needs of a given application.

The e-label reader/writer 34 also reads identification parameters stored on the e-label 44, including user identification number and cartridge identification number. The controller employs the user identification number to automatically bill the user for the toner dispensed from the consumable or ink/toner dispensing system 10 to the toner cartridge 40. The controller may employ the network interface 28 to remotely access additional user billing information based on the user identification number and charge the user based on the billing information. Alternatively, the all user billing information, such as billing address, billing instructions, credit card numbers, and so on, may be stored and accessed locally via a database incorporated in the filler dispensing system as discussed more fully below. A remote accounting system is connected to the filler dispensing system 10 via the network interface 28. The accounting system may periodically retrieve user billing information from the local database and send out bills or charge credit cards.

Alternatively, if the user does not currently have a billing account set up, the user may purchase the toner with a charge card or credit card via the card reader 26. The card reader 26 charges the user via an Asynchronous Transfer Mode (ATM) network (not shown) connected to the filler dispensing system 10 via the network interface 28.

Those skilled in the art will appreciate that the present invention may be modified to dispense filler other than printer toner and may be adapted to fill reservoirs other than printer cartridges without departing from the scope of the present invention. For example, the present invention may be employed in automotive refueling applications, hazardous materials, and fire hazard (explosives) applications.

Previous systems for filling reservoirs, such as gas station pumps, employ mechanical mechanisms to determine when a tank or reservoir is filled and to stop filling. Unfortunately, these systems are often unreliable, resulting in spilling. In automotive refueling applications, spilled gasoline is particularly problematic, as it may increase air pollution, such as ozone. Furthermore, these systems often employ mechanical lockout mechanisms to prevent filling the reservoir with unacceptable filler. For example, some diesel gas pumps may not fit in regular gasoline apertures. Unfortunately, different mechanical lockout mechanisms have not kept pace with the rapidly changing and increasing array fuel types. This has limited the ability of engine manufacturers to control the type of fuel placed in the gas tank. By employing the present invention for these applications, shortcomings with these mechanical mechanisms are avoided.

Figure 3:
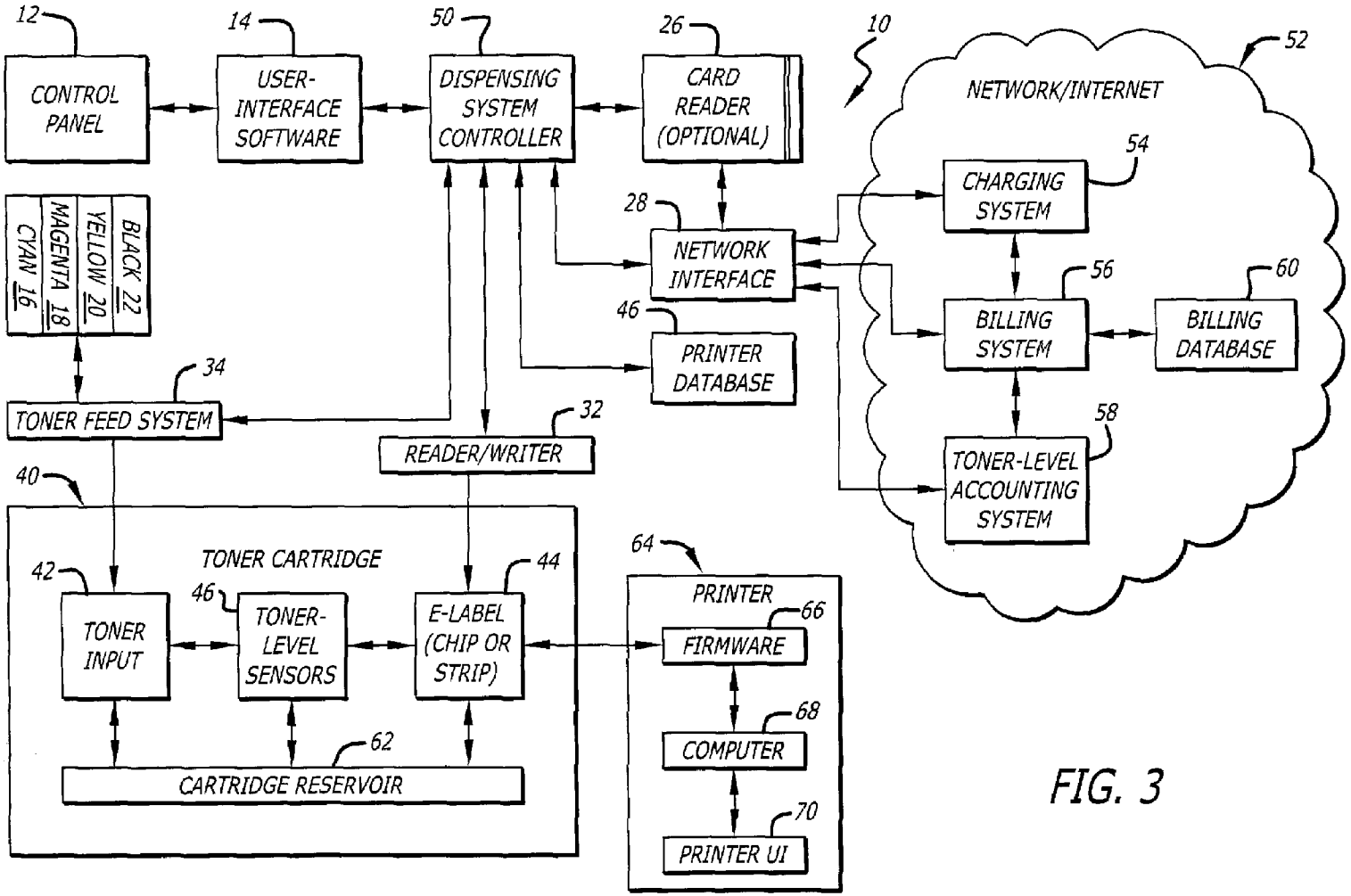
FIG. 3 is a more detailed block diagram illustrating key functional blocks of the filler dispensing system of FIG. 1.

FIG. 3 is a more detailed illustrative block diagram illustrating key functional blocks of the filler dispensing system 10 of FIG. 1. The control panel 12 communicates with user-interface software 14, which communicates with a controller 50. The controller 50 communicates with the toner feed system 34, the e-label 44 of the toner cartridge 40 (via the e-label reader/writer 34), a printer database 46, the network interface 28, and the optional card reader 26. The card reader 26 is also connected to the network interface 28.

In the present specific embodiment, the network interface 28 connects to the Internet 52 to selectively access a charging system 54, a billing system 56, and a toner-level accounting system 58. The charging system 54 and the toner-level accounting system 58 communicate with the billing system 56, which has access to a billing database 60.

The toner feed system 34 interfaces the toner containers 16-22 with the toner cartridge input 42. The toner cartridge input 42 communicates with a cartridge reservoir 62, which holds the toner. The toner level sensors 46 may communicate with the toner input 42. The toner level sensors 46 may selectively enable or unlock the toner input 42, enabling the toner input 42 to be opened and closed by the toner feed system 34. For example, when the toner level sensors 46 determine that toner levels in the cartridge reservoir 62 are low or determine that the cartridge 40 is docked in the reservoir 62, the toner level sensors 46 may unlock the toner input 42. Alternatively, the toner input 42 is automatically unlocked via a mechanical mechanism (not shown) upon docking with the reservoir 62.

The toner level sensors 46 may be implemented via various toner level sensor technologies known in the art. Toner level sensors may employ lasers, electrostatic sensors, scales, and/or other mechanisms to determine the level of toner in a toner cartridge and generate an electrical signal in response thereto.

In the present illustrative embodiment, a printer 64 that is designed to accommodate the toner cartridge 40 is shown in communication with the e-label 44. The printer 64 includes firmware 66 for writing predetermined parameters to the e-label 44 and monitoring cartridge toner levels via the toner-level sensors 46. The printer 64 also includes a printer computer 68 that communicates with the firmware 66 and a printer user-interface 70.

Those skilled in the art will appreciate that the toner-level sensors 46 may be positioned external to the toner cartridge 40, such as within the printer 64, without departing from the scope of the present invention. For example, the toner level sensors 46 may be implemented as a scale in the printer 64 that measures the weight of the toner cartridge 40 and compares the weight to a predetermined reference weight to determine the level of toner in the cartridge reservoir 62.

A user may employ the printer user-interface 70, the printer computer 68, and the firmware 66 to edit certain parameters stored on the e-label 44, such as user identification numbers, charge numbers, and so on. Functionality of the firmware 66 may be incorporated into the printer computer 68 without departing from the scope of the present invention.

In operation, the dispensing system controller 50 reads parameters stored on the e-label 44 via the reader/writer 34 to determine the quantity, type, and color of toner to transfer to the cartridge reservoir 62. The controller 50 may also read user-input from the control panel 12 that is forwarded to the controller 50 via the user-interface software 14. The user-input may override certain predetermined parameters stored on the e-label 44. For example, a user may wish to fill the toner cartridge reservoir 62 only half full. Those skilled in the art will appreciate that the extent to which a user may employ the control panel 12 and user-interface software 14 to control the operation of the system 10 is application-specific and may be determined by one skilled in the art to meet the needs of a given application.

The controller 50 activates the toner feed system 34. The toner feed system 34 then diverts the indicated amount, type, and color of toner from one or more of the toner reservoirs 16-22 to the cartridge reservoir 62 via the toner input 42 based on parameters stored on the e-label 44 and/or entered by a user via the control panel 12. The toner feed system 34 may act as a 4-to-1 multiplexer.

The dispensing system controller 50 may employ a toner cartridge identification number associated with a particular printer model to reference a printer database 46 to obtain any additional information about the toner cartridge 40 not stored on the e-label 44. For example, if the e-label 44 does not contain parameters specifying the maximum amount of toner that the cartridge reservoir 62 can accommodate, the controller 50 may employ the printer cartridge identification number to reference the printer database 46 to obtain this information.

The controller 50 obtains user identification information from the e-label 44 to facilitate customer billing. The user identification number may be a unique cartridge number or a unique printer identification number associated with a particular user. The controller 50 may forward this identification number, along with the amount and type of toner dispensed to the toner cartridge 40, to a billing system 56 on the Internet 52. The billing system 56 then references a billing database 60 to obtain user billing information based on the user identification number. The billing system 56 may then employ the billing information to charge the user via the charging system 54 or may initiate mailing of a bill to the user.

Those skilled in the art will appreciate that other charging and/or billing methods may be employed without departing from the scope of the present invention. For example, a coin and/or cash receptacle may be employed to charge the customer for the cartridge refill. Alternatively, a user may remotely credit a user account by visiting a special website and charging a credit card for credit they wish to place in the user account. The billing system 56 then automatically reduces the user's available credit based on the amount of toner dispensed to the cartridge 40.

Alternatively, the user identification number may be a credit card number or other account number unique to the user. The billing system 56 may then employ this charge number to charge the user via the charging system 54.

The billing system 56 updates user records, such as toner use history, in the billing database 60 when users employ the filler dispensing system 10 to refill the toner cartridge reservoir 62. If a unique user identification number is not available on the e-label 44, the controller 50 may direct the user via the control panel 12 and user-interface software 14 to enter their identification number or employ the card reader 26 to pay for toner to be dispensed into the toner cartridge 40.

The controller 50 may be configured to display the price for filling the cartridge reservoir 62 via the control panel 12 before filling the cartridge reservoir 62. The user may then accept the price and authorize the transaction, thereby signaling the controller 50, via the user-interface software 14, to trigger automatic filling of the reservoir 62 by the toner feed system 10 with the amount and type of toner authorized.

In some applications, the user-interface software 14 may allow a user to select the type of toner and the amount of toner to dispense to the cartridge reservoir 62. Furthermore, some parameters stored on the e-label 44, such as acceptable toner type, may be user-editable. The exact parameters and types of user-editable parameters are application-specific and may be determined by one skilled in the art to meet the needs of a given application.

Before initiating toner refilling, the controller 50 may reference a cartridge-life parameter and a number-of-refills parameter stored on the e-label 44. The number-of-refills parameter is incremented each time the toner cartridge 40 is refilled. The cartridge-life parameter specifies the maximum number of refills recommended for the toner cartridge 40 before parts of the cartridge 40 begin to mechanically degrade. When the toner cartridge 40 nears the end of its theoretical life as determined by the controller 50 by comparing the cartridge-life and number-of-refills parameters, the controller 50 commands the user-interface software 14 to display an appropriate message to the user via the control panel 12. For example, the message may inform the user that the toner cartridge 40 should be replaced. The controller 50 may be configured to not refill a toner cartridge 40 after a number of refills corresponding to the cartridge life.

The toner-level accounting system 58 communicates with the controller 50 to monitor toner consumption and levels of toner remaining in the toner containers 16-22. The dispensing system controller 50 may retrieve container filler level information from level sensors (not shown) incorporated in the toner feed system 34. Alternatively, the dispensing system controller 50 may calculate the amount of toner remaining in the containers 16-22 based on the amount of toner dispensed, as monitored by the toner feed system 34.

When the toner level in one of the toner containers 16-22 reaches a predetermined level, the dispensing system controller 50 forwards a signal to the toner-level accounting system 58. The signal specifies that toner should be added and indicates the type, color, and amount of toner that should be added to one or more of the toner containers 16-22. The dispensing system controller 50 then forwards a corresponding notification to the control panel display 12, which may alert service personal. Alternatively, the notification is emailed or otherwise automatically transferred to service personnel via the toner-level accounting system 58, thereby alerting service personal that one or more of the containers 16-22 needs refilling. The toner-level accounting system 58 may be implemented as an internal database not located on the Internet 52, without departing from the scope of the present invention.

In an alternative embodiment, the printer 64, which is designed to accommodate the printer cartridge 40, may include sensors (not shown) for monitoring existing cartridge toner levels. In this case, the printer 64 may employ the printer firmware 66 to write parameters, such as cartridge toner levels, to the e-label 44. When the cartridge reservoir 62 is empty or reaches a predetermined level, the printer firmware 66, which periodically monitors the e-label 44, notifies the user, via a printer user-interface 70 and accompanying control software 68. The printer control software 68 may also verify that the toner cartridge 40 is the correct toner cartridge for the printer 64 by referencing the user identification information, printer cartridge identification, and/or printer identification information stored on the e-label.44. The printer computer 68 may maintain a separate database (not shown) for verification purposes.

A related toner dispensing system is disclosed in U.S. patent application Ser. No. 10/109,927, filed Mar. 29, 2002, by M. Kinalski, entitled PRINTING CARTRIDGE PIGMENT REPLENISHMENT APPARATUS AND METHOD, assigned to the assignee of the present invention and incorporated herein by reference.

Those skilled in the art will appreciate that the various software modules required to implement the present invention, such as the controller 50, the user-interface software 14 and printer database 46, the printer firmware 66, and printer computer 68 may be constructed by one skilled in the art with access to the present teachings without undue experimentation.

Furthermore, those skilled in the art will appreciate that the filler dispensing system 10 of the present invention may be applied to applications other than printing consumable or ink/toner replenishing applications. For example, the present invention would be useful in various applications, such as gas station refueling applications, water bottle filling systems at grocery stores, charging stations for recharging electric vehicle batteries, and so on. The present invention may expedite filling almost any reservoir with the correct amount and type of filler and billing the user for the filler. Enhanced reservoir refilling efficiency is achieved by employing the an electronic storage medium, such as the e-label 44, to periodically store characteristics of the reservoir, including the current level of filler, the amount of filler desired, the type of filler desired, and user billing information. This stored information is referenced by the dispensing system 10 to enable dispensing of the correct amount and type of filler and to automatically bill the user accordingly.

FIG. 4 is a flow diagram of a method 80 adapted for use with the filler dispensing system 10 of FIG. 1. With reference to FIGS. 3 and 4, in an initial parameter-storing step 82, various parameters are stored on the e-label 44, including cartridge identification, printer identification, printer cartridge identification, printer cartridge life, and toner color and type. The various identification numbers may be substituted with a single identification number. The remaining identification numbers may be accessed with reference to a database, such as the printer database 46 of FIG. 3. Some of the parameters, such as identification numbers, may be pre-stored on the e-label 44 upon initial sale of the toner cartridge 40 and/or accompanying printer 64 of FIG. 3. Alternatively, the parameters may be automatically written to the e-label 44 via the printer firmware 66 or written in response to user input via the printer user-interface 70. Alternatively, the parameters may be written to the e-label 44 via the controller 50 and reader/writer 34 in response to user input received by the dispensing system controller 50 via the control panel 12 and user-interface software 14.

In a subsequent toner-tracking step 84, certain dynamic parameters, such as the current cartridge reservoir toner level, are periodically written to the e-label 44 via the toner-level sensors 46 in the toner cartridge 40 or printer firmware 66 and level sensors (not shown) incorporated in the printer 64. Subsequently, control is passed to a refill-checking step 86.

In the refill-checking step 86, refilling-criterion are checked with reference to current cartridge reservoir toner levels indicated on the e-label 44 to determine if the printer cartridge 40 is ready to be refilled. If the printer cartridge 40 is ready for refilling, then control is passed to a cartridge-removing step 88. Otherwise, control is passed back to the toner-tracking step 84.

In the cartridge-removing step 88, the user removes the toner cartridge 40 from the printer 64 and inserts it into the filler dispensing system 10 so that the toner feed system 34 has access to the toner input 42, and the e-label reader/writer 34 has access to the e-label 44.

In a subsequent e-label-reading step 90, the controller 50 employs the reader/writer 34 to read the parameters stored on the e-label 44. The controller 50 may also obtain additional parameters or edits to existing parameters from the user via the control panel 12 and user-interface software 14. In the present specific embodiment, the controller 50 employs the user-interface software 14 to display any needed user instructions via the control panel 12.

If the user has failed to insert the toner cartridge 40 so that the reader/writer 34 can effectively read the e-label 44, the dispensing system controller 50 issues appropriate user instructions via the control panel 12 and user-interface software 14. The toner dispensing system 10 may include additional sensors (not shown) to ensure that the printer cartridge 40 is properly inserted into the filler dispensing system 10. When the toner cartridge 40 is properly inserted, all connections between the toner cartridge 40 and the filler dispensing system 10 are secure, and the toner cartridge 40 is positioned in appropriately so that the toner feed system 34 can distribute the correct toner to the toner cartridge 40.

Subsequently, control is passed to a toner-dispensing step 92. In the toner-dispensing step 92, the filler dispensing system 10 fills the toner cartridge reservoir 62 with a predetermined amount of toner based on the parameters read from the e-label 44.

In a subsequent reporting step 94, the filler dispensing system 10 employs the controller 50 and network interface 28 to report the amount of toner dispensed to the toner cartridge 40 from the toner containers 16-22 to the billing system 56 and the toner-level accounting system 58. The filler dispensing system 10 also forwards the user identification number obtained from the e-label 44 to the billing system 56. The billing system 56 then generates a bill for the cost of the toner, which is sent to the user, or automatically charges the user via the charging system 54 and via any credit card number on file in the billing database 60.

Subsequently, control is passed to a task-notification step 96, where the filler dispensing system 10 notifies the user, via the control panel 12, that the toner refill is complete. The user then installs the refilled printer cartridge 40 into the printer 64 in an installation step 98. In a final verification step 100, the printer 64 may then employ the printer computer 68 and any internal toner level sensors (not shown) to verify that the toner cartridge 40 is full and is the correct cartridge and to display the current cartridge toner level via the printer user-interface 70.

Those skilled in the art will appreciate that certain steps in the toner replenishing method 80 may be omitted or interchanged with other steps without departing from the scope of the present invention. For example, the verification step 100 may be omitted, and the order of the steps 94 and 96 may be reversed.

The process of refilling the toner cartridge 40, billing the user via the billing system 56 and billing database 60, analyzing toner inventory and usage via the toner-level accounting system 58, and procuring additional toner when needed are greatly expedited by employing the system 10 of FIGS. 1 and 3 and the method 80 of the present invention.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. A toner dispensing system comprising:

at least one toner reservoir;

a receptacle for receiving a removable toner cartridge;

a controller;

a user interface in communication with said controller;

a display coupled to said controller; and a feed system adapted to transfer toner from said reservoir to said cartridge in response to said controller.

2. The invention of claim 1 wherein said receptacle includes a contact adapted to engage a contact on said cartridge.

3. The invention of claim 2 wherein said contact is an E-LABEL type contact and said system includes an E-LABEL reader/writer.

4. The invention of claim 3 wherein said controller is adapted to fill said cartridge in respond to data stored on said E-LABEL type contact.

5. The invention of claim 3 wherein said controller is adapted to fill said cartridge in response to data entered by a user via said user interface.

6. The invention of claim 3 wherein said controller is adapted to obtain printer cartridge information from a printer database.

7. The invention of claim 1 further including a card reader.

8. The invention of claim 1 further including a network interface.

9. The invention of claim 8 wherein said controller includes means for accessing a charging system.

10. The invention of claim 8 wherein said controller includes means for accessing a billing system.

11. The invention of claim 8 wherein said controller includes means for accessing an accounting system.

12. A method for refilling a cartridge including the steps of:

inserting said cartridge into a receptacle of a dispensing system, said dispensing system having:

at least one reservoir;

said receptacle for receiving said removable cartridge;

a controller;

a user interface in communication with said controller;

a display coupled to said controller; and a feed system adapted to transfer material from said reservoir to said cartridge in response to said controller;

using said user interface to initiate a refill operation; and removing said cartridge from said receptacle.

13. The invention of claim 12 further including the step of automatically detecting a refill amount for said cartridge.

14. The invention of claim 12 further including the step of automatically billing a user for said refill operation.

15. The invention of claim 12 further including the step of automatically detecting a correct type of toner and dispensing the correct type of toner.

* * * * *

UNITED STATES PATENT AND TRADEMARK OFFICE

CERTIFICATE OF CORRECTION

PATENT NO. : 7,702,419 B2
APPLICATION NO. : 10/198545
DATED : April 20, 2010
INVENTOR(S) : Michael Kinalski et al.

It is certified that error appears in the above-identified patent and that said Letters Patent is hereby corrected as shown below:

In column 10, line 21, in Claim 4, delete "respond" and insert -- response --, therefor.

Signed and Sealed this

Third Day of August, 2010

David J. Kappos

David J. Kappos
*Director of the United States Patent and Trademark Office*